US005460270A

United States Patent [19]

Chan et al.

[11] Patent Number: 5,460,270

[45] Date of Patent: Oct. 24, 1995

[54] OIL SAND EXTRACTION PROCESS WITH IN-LINE MIDDLINGS AERATION AND RECYCLE

[75] Inventors: Edward W. Chan, Edmonton; Robert S. MacTaggart, Fort McMurray, both of Canada

[73] Assignees: Alberta Energy Company Ltd.; Canadian Occidental Petroleum Ltd.; Esso Resources Canada Limited, all of Calgary; Gulf Canada Resources Limited, Toronto; Her Majesty the Queen in right of the Province of Alberta, as represented by the Minister of Energy and Natural Resources, Edmonton; HBOG-Oil Sands Limited Partnership, Calgary; PanCanadian Petroleum Limited, Calgary; Petro-Canada Inc., Calgary; Mocal Energy Limited, Calgary, all of Canada

[21] Appl. No.: 115,006

[22] Filed: Sep. 1, 1993

[51] Int. Cl.[6] ..... C10G 1/04

[52] U.S. Cl. ..... 209/164; 208/390; 208/391; 208/425; 261/DIG. 75

[58] Field of Search ..... 209/164, 170; 208/390, 391, 425; 261/DIG. 75

[56] References Cited

U.S. PATENT DOCUMENTS 1,869,241 7/1932 Elie .
2,687,213 8/1954 Macleod .
3,401,110 9/1968 Floyd .
3,487,003 12/1969 Baillie .
3,496,093 2/1970 Camp .
3,502,566 3/1970 Raymond .
3,509,037 4/1970 Tse .
3,526,585 9/1970 Camp .
3,530,041 9/1970 Erskine .
3,530,042 9/1970 Graybill .
3,558,469 1/1971 White .
3,619,406 11/1971 Bowman .
3,847,789 11/1974 Cymbalisty .
3,864,251 2/1975 Cymbalisty .
3,931,006 1/1976 Baillie .
3,963,599 6/1976 Davitt .
3,969,220 7/1976 Anderson .
4,018,665 4/1977 Anderson .
4,343,691 8/1982 Minkkinen .
4,456,533 6/1984 Seitzer .
4,533,459 8/1985 Dente .
4,545,892 10/1985 Cymbalisty .
4,561,965 12/1985 Minkkinen .
4,776,949 10/1988 Leung et al. .
4,981,582 1/1991 Yoon .
5,151,177 9/1992 Roshanravan .
5,167,798 12/1992 Yoon .

*Primary Examiner*—Thomas M. Lithgow
*Attorney, Agent, or Firm*—Millen, White, Zelano, & Branigan

[57] ABSTRACT

Middlings from the primary separation vessel ("PSV") are recycled through a line to the PSV. The middlings are aerated with fine air bubbles using in line eductor/aerator assemblies. The aerated middlings are mixed as they are pumped through a line back to the PSV. Bitumen recovery from the PSV is increased as a result.

1 Claim, 6 Drawing Sheets

OIL SAND EXTRACTION PROCESS WITH IN-LINE MIDDLINGS AERATION AND RECYCLE

FIELD OF THE INVENTION

This invention relates to an improvement of the hot water extraction process for recovering bitumen from oil sand. More particularly, it relates to aerating a stream of middlings withdrawn from the primary separation vessel and recycling the aerated middlings back into the vessel.

BACKGROUND OF THE INVENTION

The oil sands of the Fort McMurray region in Northern Alberta constitute a major reservoir of heavy oil or bitumen.

These oil sands comprise water-wetted sand grains having flecks of bitumen and fine clay particles disposed in the interstices between the grains.

At the present time, there are two large scale, surface mining operations recovering bitumen from the oil sands. One is owned by the assignees of the present application. Both operations involve first mining the oil sand and then using the hot water extraction process to extract the bitumen from the as-mined oil sand.

In order to appreciate the attributes of the present invention, it is necessary to have a general understanding of the nature of the hot water extraction process. This process is described in the technical literature but will now be briefly described in terms of the specific circuit used in the present assignee's plant. This prior art circuit is schematically illustrated in FIG. 1. More particularly:

The as-mined oil sand is first mixed with hot water (~90° C.) and NaOH, by passing it through a horizontal rotating drum (referred to as a tumbler), to produce a slurry having a temperature of about 80° C. Typically the oil sand is mixed in the tumbler with about 20 wt. % hot water and 0.02 wt. % NaOH (both based on the weight of the oil sand). The tumbler retention time is about 3 minutes. Steam is sparged into the slurry as it moves through the tumbler, to ensure the desired slurry exit temperature. In the course of being mixed and cascaded during passage through the tumbler, the following mechanisms are thought to occur: the NaOH generates surfactants in situ by reacting with constituents of the bitumen; the temperature and viscosity of the bitumen changes and it separates from the sand grains and is dispersed into the water phase of the slurry; fine air bubbles are entrained in the slurry; bitumen flecks coalesce into larger flecks; and some bitumen flecks and air bubbles of comparable size contact and the bitumen coats the air bubble to produce buoyant aerated bitumen. The term "conditioning" is applied in the art to describe the sum of these various happenings;

The product slurry is screened, to reject oversize material, such as rocks, and is then diluted with additional hot water to increase the slurry water content to about 60 wt. %;

The diluted slurry is introduced into a large thickener-like vessel having a conical bottom section and open-topped cylindrical upper section. This vessel is referred to as the primary separation vessel ("PSV"). The residence time of the slurry in the PSV is approximately 45 minutes. During this time, the sand sinks, is concentrated in the conical section and is pushed by rakes to a bottom outlet and removed as a tailings underflow. Some bitumen is lost with this underflow. Simultaneously, much of the still non aerated bitumen becomes aerated in the PSV as the non-aerated and aerated bitumen flecks and air bubbles continue to contact, in many cases rendering the aerated bitumen sufficiently buoyant to rise through the PSV fluid column. The rising aerated bitumen forms a froth layer on the upper surface of the PSV. This froth overflows the top rim of the PSV and is recovered and led away in a launder. In the mid-section of the PSV is a watery suspension referred to as "middlings", containing flecks of non-buoyant bitumen and dispersed fine solids. A drag-stream of middlings is withdrawn from the PSV through an outlet in its mid-section wall. Although there is variance in the composition of the middlings, they typically contain 1–2 wt. % bitumen;

To recover the residual bitumen contained in the PSV tailings and middlings, they are combined and processed in what is referred to as the "post-primary circuit". More particularly, the combined stream is fed to a deep cone vessel referred to as the tailings oil recovery vessel ("TORV"). This vessel and its method of operation is disclosed in U.S. Pat. No. 4,545,892. Briefly stated, the incoming feed to the vessel is deflected and spread out laterally and contacted from below by an upwelling stream of aerated and recycled TORV middlings. The air bubbles in the recycled middlings contact and aerate previously non-buoyant bitumen in the feed and a "secondary" bitumen froth is produced. This secondary froth is more contaminated with water and solids than primary froth from the PSV. The TORV secondary froth is recovered by overflowing the lip of the TORV and being led away in a launder. A solids-rich tailings stream, low in bitumen content, is produced as a TORV underflow. A middlings stream is withdrawn from the mid-section of the TORV. Part of this TORV middlings stream is aerated and recycled, as aforesaid.

The balance of the TORV middlings is forwarded to a bank of impeller-agitated, sub-aerated flotation cells. In these mechanical flotation cells, the TORV middlings are relatively vigorously agitated and aerated to produce a heavily contaminated flotation froth, together with a tailings underflow;

The flotation froth is temporarily retained in a tank, to allow some solids and water to settle out. The "cleaned" flotation and TORV froth are then combined with the PSV froth to yield a product stream that is subjected to two stages of centrifugation, to remove contained water and solids, thereby producing clean bitumen ready for refinery upgrading.

It will be appreciated from the foregoing description that the fundamental recovery mechanism in the hot water extraction process is air flotation. In order to achieve an adequate recovery using flotation, it is desirable:

That the air is supplied in the form of fine bubbles;

That the air bubbles and bitumen flecks are of approximately equal size, perhaps having a diameter in the order of 1 mm;

That the air be supplied in sufficient amount; and

That the air bubbles and bitumen flecks have an opportunity to mix in a manner whereby contact between them is promoted.

Stated otherwise, a sufficient number of air bubbles and bitumen flecks must contact and unite to create a commercially viable yield of sufficiently buoyant bitumen which is able to rise through the vessel contents within the allocated retention time and be recovered as froth.

It is always unpredictable, when attempting a new approach to aeration in the context of the hot water extraction process, whether a sufficient number of the bitumen flecks will, in the first instance, contact bubbles of air and, in the second instance, whether a contacting bubble and fleck will unite to produce sufficiently buoyant aerated bitumen.

At this point, it is appropriate to point out that the applicant has used, in the present invention, some features of an aeration technique taught in U.S. Pat. No. 4,545,892 (The TORV patent). In that patent, it is taught to suspend a plenum or hollow vessel in a submerged state in the TORV chamber. Eductor/aerator devices are mounted to openings leading into the lower end of the plenum. These eductor/aerator devices function to inject air bubbles and recycled TORV middlings into the plenum. The produced aerated mixture exits the upper end of the plenum through outlets, to provide the previously mentioned upwelling stream. Each eductor/aerator device comprises:

a venturi tube connected to the plenum at an inlet;

a tubular nozzle member positioned close to, but gapped from the venturi tube inlet, said nozzle member being connected by a line with a pump for the supply of recycled TORV middlings, to create a liquid jet issuing from the nozzle member outlet; and a tubular sparger positioned in an outwardly spaced, concentric relation about the nozzle member outlet, said sparger being connected by a line with a source of pressurized air, for supplying a high velocity, annular stream of air surrounding the middlings jet;

whereby the motive jet of recycled TORV middlings induces a flow of unaerated middlings from the TORV chamber through the gap formed between the nozzle member and venturi tube, and the injected air flow is dispersed by the jet into the form of fine air bubbles that mix with the middlings in the plenum.

This TORV aeration system has worked adequately on a commercial basis. However it will be appreciated that, if the eductor/aerator devices become plugged or damaged, it is a major operation to make the necessary repairs. The TORV has to be shut down and drained to enable access to the normally submerged devices. This results not only in labour and repair costs but, more importantly, in lost production.

With this background in mind, it is now appropriate to describe the present invention.

BACKGROUND OF THE INVENTION

In accordance with the invention, a stream of middlings, withdrawn from the PSV, is aerated with air bubbles and is then recycled to the PSV.

The middlings are aerated in-line—that is, as they move through the conduit returning them to the feed assembly of the PSV.

More particularly, at least part of the middlings stream leaving the PSV is sub-divided into a plurality of sub-streams; these sub-streams are each passed through one of a bank of in-line eductor/aerator assemblies arranged in parallel, external of the PSV. The sub-stream of middlings passing through each eductor/aerator assembly is aerated with fine air bubbles. The so-aerated middlings may be mixed with additional non-aerated recycled middlings. The resulting aerated middlings streams are then recombined into a single stream, and pumped through a return line to the PSV.

The term "aerating" as used herein is intended to mean, in a broad context, introducing air bubbles into the middlings, the bubbles being mixed with the middlings so that they are enabled to contact bitumen flecks, the bubbles being of a size so that bitumen may coat them when the two contact, to create aerated bitumen which is sufficiently buoyant to reach the bitumen froth layer in the PSV in the allotted PSV retention time.

In the specific embodiment disclosed, an annular stream of air is brought into contact in-line with a jet of recycled middlings, so that fine air bubbles having a size in the order of 1 mm are created. These fine bubbles are mixed with middlings in the course of being pumped through a return line conveying them to the PSV feed line. The air/middlings mixture is then mixed with fresh diluted feed slurry and is pumped therewith through the feed line leading into the PSV.

It has been shown that a stand-alone PSV (that is, a PSV operated without a post-primary circuit comprising sequential TORV and flotation cells), when operated in conjunction with appropriate middlings aeration and recycle, can yield a viable recovery of bitumen in the form of primary froth, said recovery and the quality of the froth being comparable or equivalent to those obtained from a conventional system comprising a PSV used in conjunction with a post-primary circuit.

By utilizing the best mode of this improved system, one can achieve the following advantages:

Maintenance costs can be significantly reduced because the eductor/aerator assemblies are external of the PSV and are readily accessible for servicing;

Production losses can be reduced because only a single eductor/aerator assembly that requires service needs to be shut down—the remaining assemblies can remain in service;

The eductor/aerator assemblies operate at optimum efficiency, since poor performing eductor/aerator assemblies can be detected and repaired easily;

Capital and operating costs can be reduced by eliminating the post-primary circuit or minimizing its usage; and Overall water consumption can be reduced, due to recycling the middlings.

DESCRIPTION OF THE PREFERRED EMBODIMENT

Figure 3:
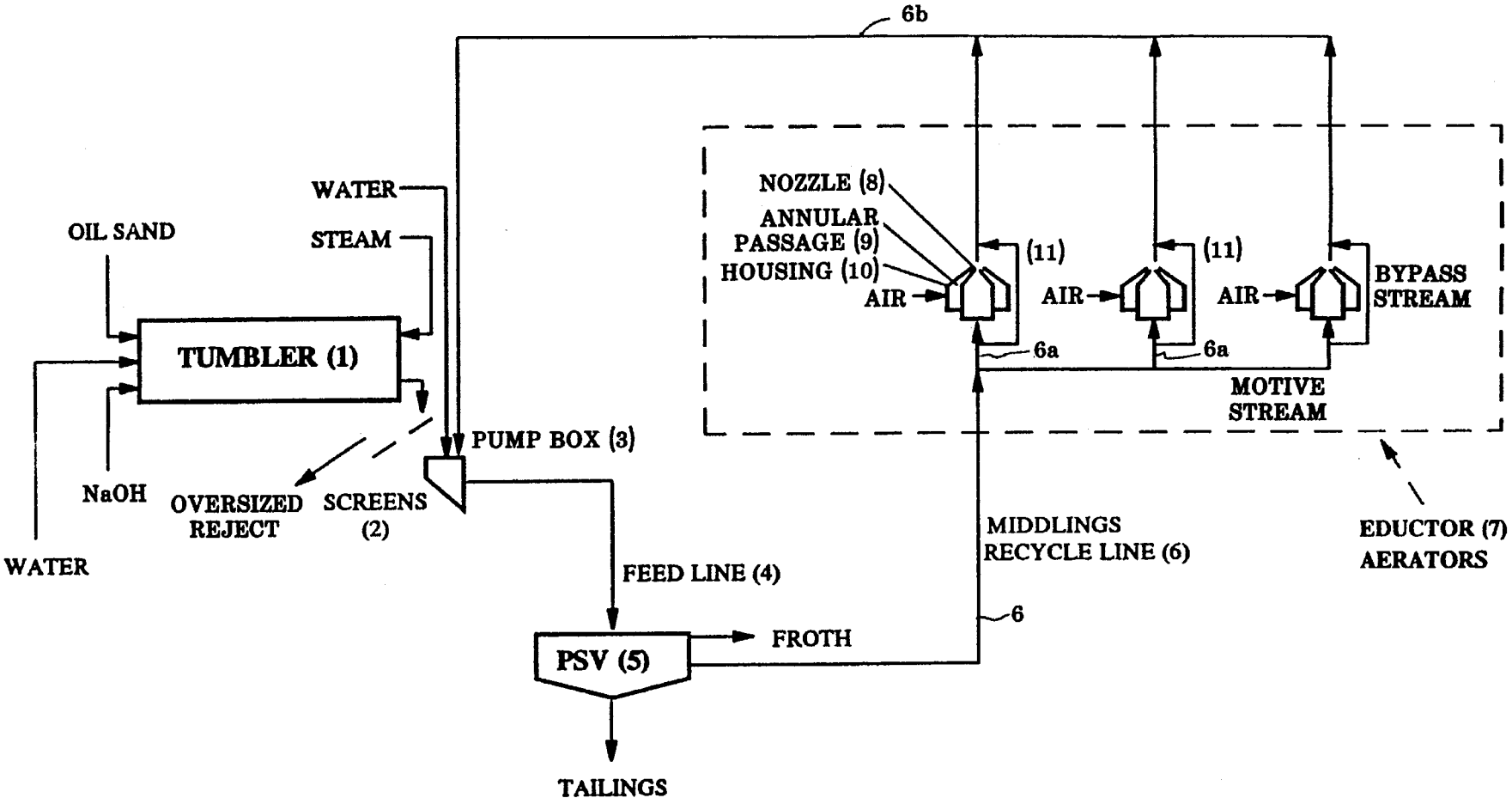
FIG. 3 is a schematic flowsheet showing the best mode of the invention as contemplated by the applicants, said flowsheet showing only a primary circuit in conjunction with a primary middlings aeration and recycle circuit having multiple eductor/aerator assemblies in parallel.
Figure 4:
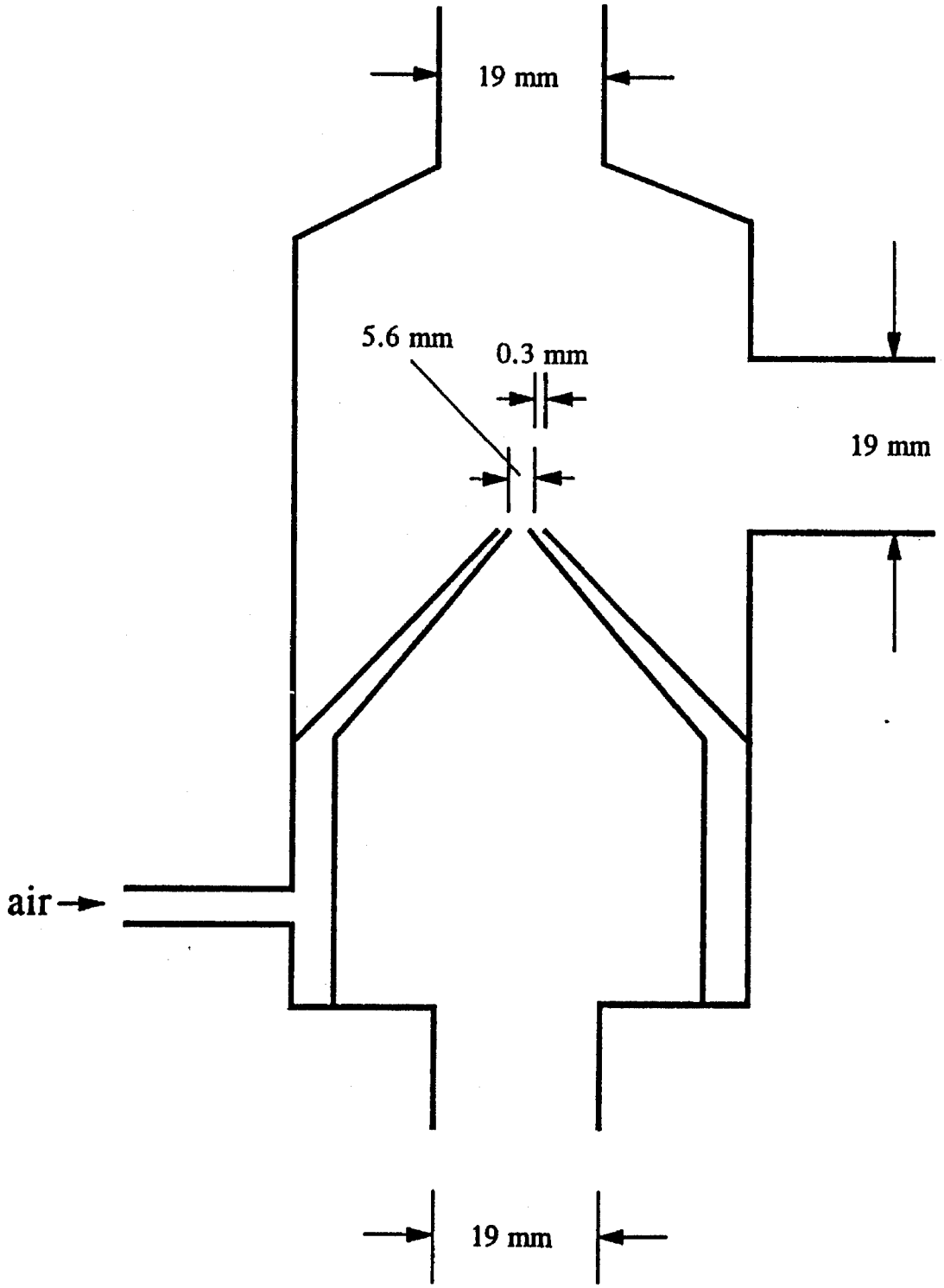
FIG. 4 is a sectional plan view of the eductor/aerator assembly used in the test runs, showing the important dimensions of the unit used in the pilot runs.
Figure 5A:
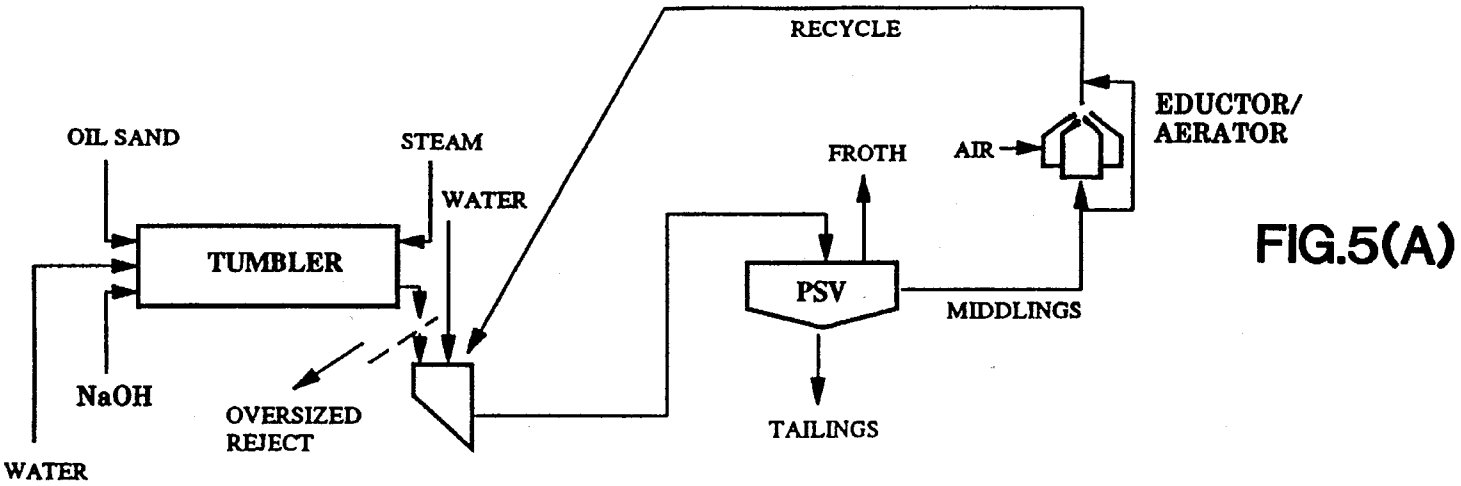
FIGS. 5a–5d show four flowsheet configurations which were tested in runs conducted on a comparative basis.
Figure 5B:
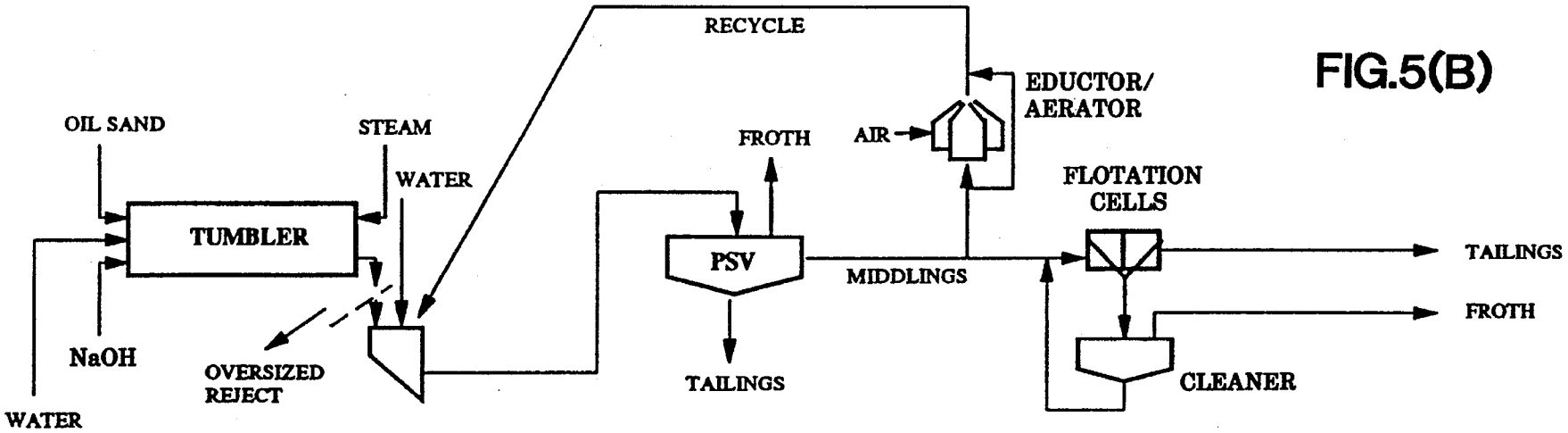
Figure 5C:
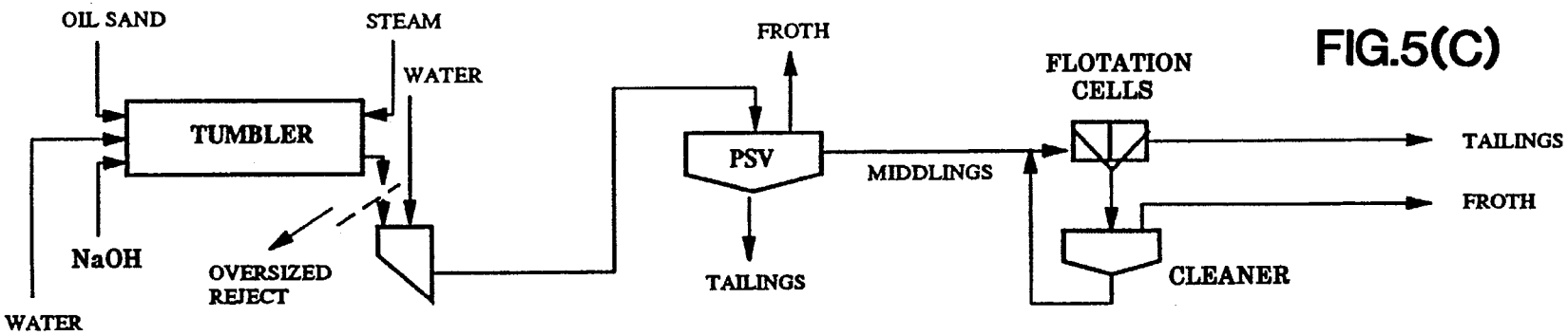
Figure 5D:
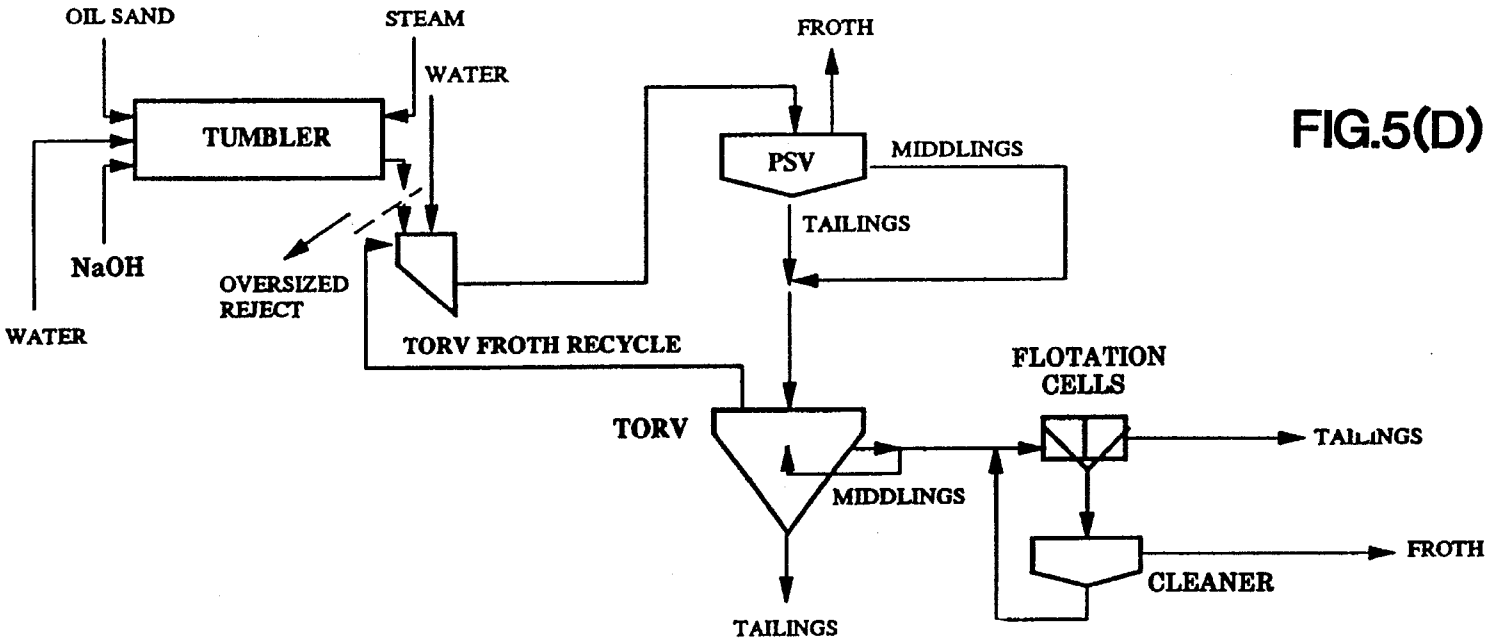

The preferred modified primary circuit in accordance with the invention is shown schematically in FIG. 3. It comprises a tumbler 1, into which as-mined oil sand, hot water, steam and process aid (NaOH) are fed for mixing. Hot oil sand slurry is produced from the tumbler 1 and is screened by screen assembly 2, to reject oversize material. The screened slurry is then conveyed into a pump box 3, wherein it is diluted with additional hot water. The diluted slurry produced from the pump box 3 is fed through a feed line 4 into a PSV 5. The diluted slurry is temporarily retained in the PSV under quiescent conditions to produce an overflowing primary bitumen froth stream, an underflow sand tailings stream, and a middlings stream recovered from the mid-section of the PSV. The middlings are pumped through a withdrawal line 6 to a bank of eductor/aerator assemblies 7 arranged in parallel. More particularly, each eductor/aerator assembly 7 is mounted in an aeration line 6a connected at one end with the withdrawal line 6 and at the other end with a return line 6b. Here the middlings stream is sub-divided into a plurality of sub-streams. Each such sub-stream is itself divided into a motive stream and a bypass stream. The motive stream passes through a restrictive nozzle 8, to create a central jet of middlings. An annular stream of pressurized air is injected through an annular passage 9, formed between the housing 10 of the assembly 7 and the nozzle 8. The annular stream of air surrounds the jet of middlings. Upon contacting the liquid jet, the air forms fine air bubbles which are entrained in the turbulent liquid. The bypass stream of middlings is conveyed by a line 11 to a point immediately downstream of the nozzle 8, where it contacts and mixes with the air bubbles and motive stream of middlings. The aerated mixtures issuing from the various eductor/aerator assemblies 7 are combined into a single stream in the return line 6b. The aerated middlings passing through the return line 6b are conveyed to join the fresh feed slurry in the pump box 3, for subsequent introduction into the PSV 5. During passage through the assemblies 7 and return line 6b, the air bubbles mix with the middlings and contact between air bubbles and bitumen flecks occurs.

Figure 1:
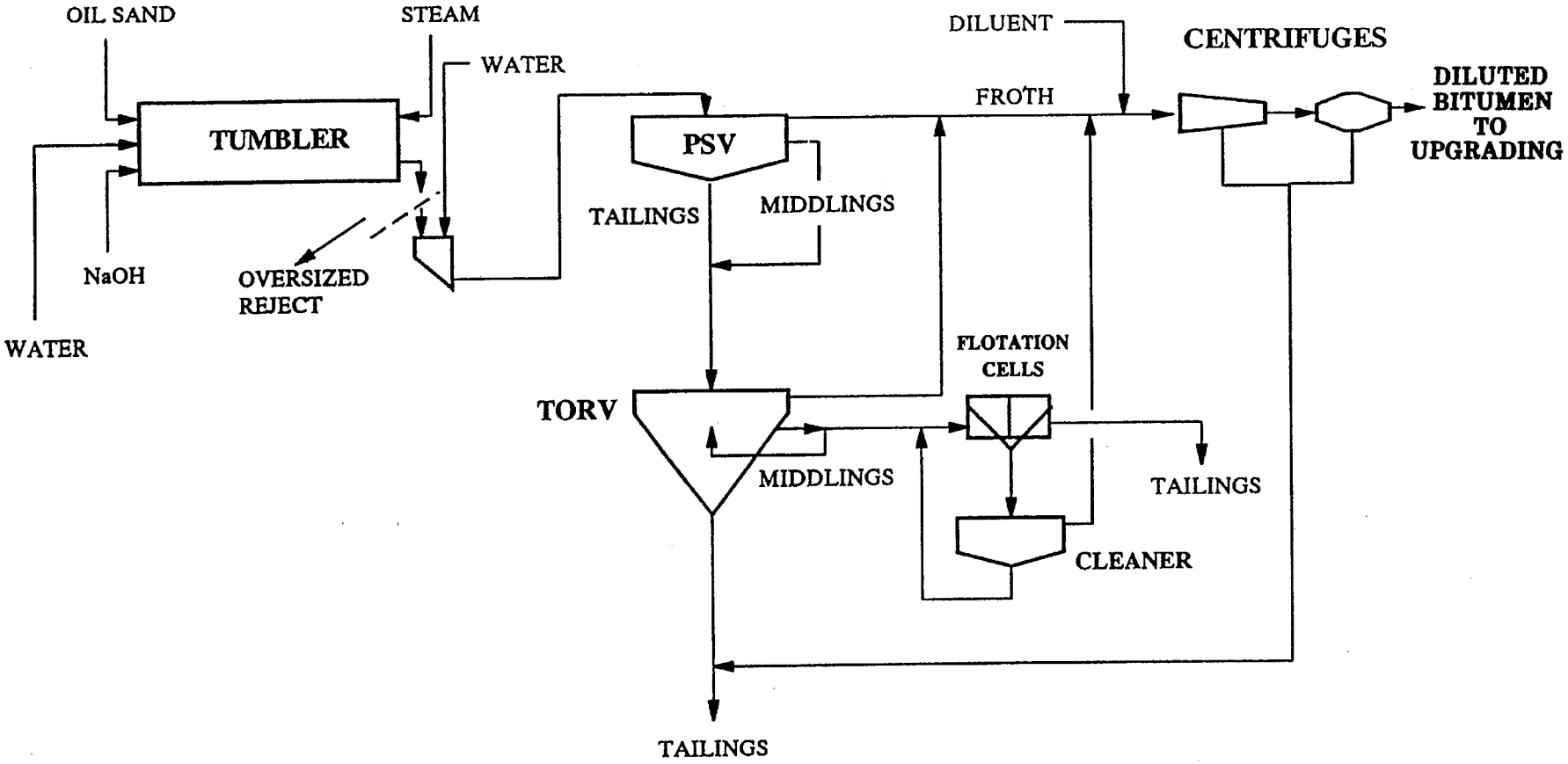
FIG. 1 is a schematic flowsheet showing the prior art assembly used in the plant owned by the present assignees.
Figure 2:
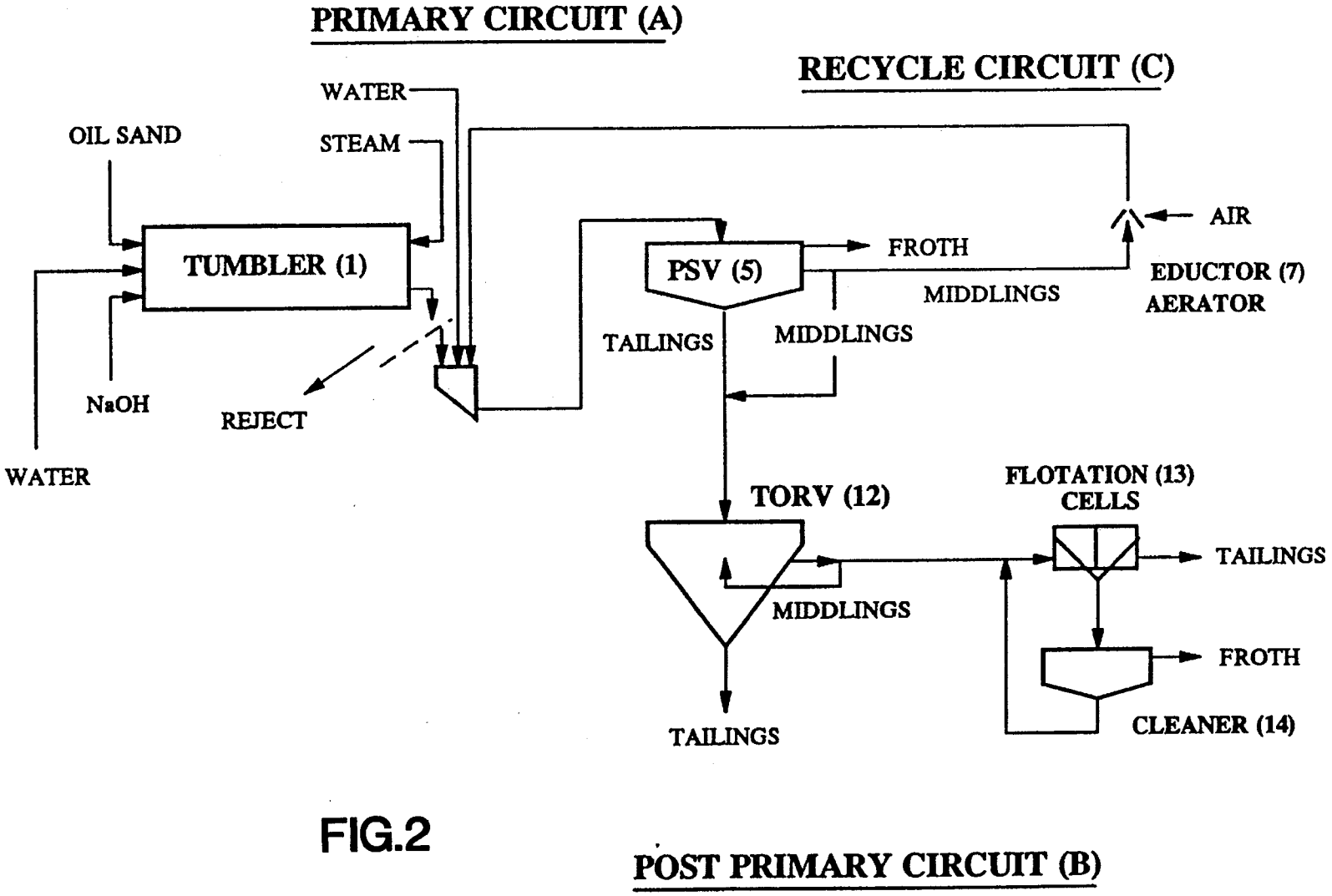
FIG. 2 is a schematic flowsheet showing the pilot plant used in developing the present invention. The plant incorporated a primary circuit involving tumbler and PSV, a post-primary circuit involving TORV and flotation cells, and a primary middlings aeration and recycle circuit involving a single eductor/aerator assembly.

The invention has been tested in a pilot plant illustrated schematically in FIG. 2. The plant was equipped with a primary circuit A comprising a tumbler 1 and PSV 5, a post-primary circuit B comprising a TORV 12, flotation cells 13, and cleaner tank 14, and a PSV middlings aeration and recycle circuit C comprising a single eductor/aerator assembly 7. The TORV 12, flotation cells 13, cleaner 14 and recycle circuit C could each be excluded from the process by closing appropriate valves.

Five different process configurations or flowsheets were tested, namely:

(a) the primary circuit coupled only with the PSV middlings aeration and recycle circuit, wherein all the PSV middlings were recycled;

(b) the primary circuit coupled with the PSV middlings aeration and recycle circuit and a post-primary circuit having flotation cells and cleaner, wherein part of the PSV middlings were recycled and part were treated in the post-primary circuit;

(c) the primary circuit coupled with a post-primary circuit having the flotation cells and settler (there was no middlings recycle);

(d) the "base case" consisting of a primary circuit coupled with a post-primary circuit, the post-primary circuit having the TORV, flotation cells and cleaner (there was no middlings recycle). The TORV froth was recycled to the PSV feed pump box.

More particularly, Athabasca oil sand samples of similar composition were subjected to runs in the pilot plant shown in FIG. 2. Typical oil sand composition was: oil—9.13%; water—5.12%; and solids—85.75%. As many conditions as possible were kept essentially the same. The nominal tumbler water and total water to oil sand ratios were 20% and 75% respectively. The pilot plant was modified, as shown in FIG. 5, to provide the various flowsheet configurations (a) (b) (c) and (d). The conditions and recovery results of five selected runs are set forth in Table I.

TABLE I

| | | Run Summaries | | | |
|---|---|---|---|---|---|
| Flowsheet Configuration | | (a) | (b) | (c) | (d) |
| PSV Recovery (%) | | 70.44 | 55.76 | 58.74 | 68.51 |
| TORV Recovery (%) | | | | | 49.19 |
| Flotation Cell Recovery (%) | | | 83.33 | 81.39 | 34.80 |
| Overall Recovery (%) | | 81.16 | 82.49 | 84.73 | 85.87 |
| Overall Froth: | Oil (%) | 65.60 | 64.01 | 59.50 | 64.28 |
| | Water (%) | 26.01 | 27.74 | 30.98 | 27.16 |
| | Solids (%) | 8.39 | 8.25 | 9.52 | 8.55 |
| Oil Sands: | Rate (g/s) | 828.53 | 850.65 | 815.63 | 791.75 |
| | Composition | | | | |
| | Oil (%) | 9.13 | 8.95 | 8.15 | 8.95 |
| | Water (%) | 5.08 | 5.10 | 5.64 | 3.34 |
| | Solids (%) | 85.79 | 85.95 | 86.21 | 87.70 |
| Caustic (wt. %) | | 0.06 | 0.06 | 0.06 | 0.05 |
| Tumbler Water + Steam Rate (g/s) | | 198.27 | 207.61 | 186.32 | 191.28 |
| Flood Water Rate (g/s) | | 418.04 | 441.04 | 418.84 | 414.14 |
| Total Water Rate (% O.S.) | | 74.39 | 76.25 | 74.20 | 76.47 |
| Reject: | Rate (g/s) | 71.92 | 54.82 | 70.32 | 59.72 |
| | Oil (%) | 2.94 | 3.38 | 4.35 | 2.35 |
| | Water (%) | 11.48 | 11.27 | 11.19 | 13.12 |
| | Solids (%) | 85.58 | 85.35 | 84.46 | 84.53 |
| PSV: | Feed Rate (g/s) | 1,791 | 1,756 | 1,350 | 1,712 |
| | Oil (%) | 4.73 | 4.88 | 4.7 | 4.80 |

TABLE I-continued

| Flowsheet Configuration | | Run Summaries (a) | (b) | (c) | (d) |
|---|---|---|---|---|---|
| | Water (%) | 51.63 | 50.49 | 47.63 | 50.38 |
| | Solids (%) | 43.64 | 44.63 | 47.67 | 44.82 |
| PSV: | Froth Rate (g/s) | 90.97 | 69.32 | 54.18 | 84.51 |
| | Oil (%) | 65.60 | 68.93 | 68.82 | 66.65 |
| | Water (%) | 26.01 | 24.65 | 25.48 | 25.65 |
| | Solids (%) | 8.39 | 6.42 | 5.70 | 7.70 |
| PSV: | Middlings Rate (g/s) | 418.11 | 604.17 | 546.32 | 726.40 |
| | Oil (%) | 2.68 | 3.39 | 3.71 | 2.47 |
| | Water (%) | 65.67 | 65.52 | 65.42 | 67.31 |
| | Solids (%) | 31.65 | 31.09 | 30.87 | 30.22 |
| PSV: | Tailings Rate (g/s) | 1,282 | 771.00 | 749.98 | 901.24 |
| | Oil (%) | 1.08 | 0.78 | 0.79 | 0.88 |
| | Water (%) | 48.87 | 35.40 | 36.27 | 39.05 |
| | Solids (%) | 50.05 | 63.82 | 62.94 | 60.07 |
| Total Recycle Flow (g/s) | | 418.1 | 311.6 | — | 374.71 |
| Nozzle Flow (lpm) | | 15.0 | 17.6 | — | |
| Air Rate (scfm) | | 2.0 | 2.0 | | |
| TORV: | Feed Rate (g/s) | — | — | — | 1,627.65 |
| | Oil (%) | — | — | — | 1.59 |
| | Water (%) | — | — | — | 51.66 |
| | Solids (%) | — | — | — | 46.75 |
| TORV: | Froth Rate (g/s) | — | — | — | 374.71 |
| | Oil (%) | — | — | — | 3.40 |
| | Water (%) | — | — | — | 63.65 |
| | Solids (%) | — | — | — | 32.95 |
| TORV: | Middlings Rate (g/s) | — | — | — | 711.91 |
| | Oil (%) | — | — | — | 1.35 |
| | Water (%) | — | — | — | 60.13 |
| | Solids (%) | — | — | — | 38.53 |
| TORV: | Tailings Rate (g/s) | — | — | — | 541.03 |
| | Oil (%) | — | — | — | 0.66 |
| | Water (%) | — | — | — | 32.22 |
| | Solids (%) | — | — | — | 67.12 |
| Flotation Feed Rate (g/s) | | — | 604.17 | 546.32 | 711.91 |
| | Oil (%) | — | 2.68 | 3.71 | 1.35 |
| | Water (%) | — | 65.87 | 65.42 | 60.13 |
| | Solids (%) | — | 31.65 | 30.87 | 38.53 |
| Flotation Cleaner Froth Rate (g/s) | | — | 26.41 | 36.20 | 8.30 |
| | Oil (%) | — | 51.09 | 45.57 | 40.15 |
| | Water (%) | — | 35.84 | 39.20 | 42.57 |
| | Solids (%) | — | 13.07 | 15.23 | 17.27 |
| Flotation Tailings Rate (g/s) | | — | 577.76 | 510.12 | 703.60 |
| | Oil (%) | — | 1.21 | 0.74 | 0.89 |
| | Water (%) | — | 66.88 | 67.28 | 60.34 |
| | Solids (%) | — | 31.91 | 31.98 | 38.78 |

It will be noted from FIG. 5 and Table I that the total bitumen recovery and froth quality from the run in circuit (d) (full PSV middlings aeration-recycle/no post-primary) were comparable to the recovery and froth quality results obtained from the run in the conventional base case circuit (d) (no PSV middlings recycle/full post-primary circuit with TORV froth recycle).

It will further be noted from runs conducted in circuit (b) that one may combine some PSV middlings aeration-recycle with partial post-primary treatment with total bitumen recovery comparable to the base case.

The embodiments of the invention in which an exclusive property or privilege is claimed are defined as follows:

1. In the primary circuit of the hot water extraction process for recovering bitumen from oil sand, wherein the oil sand is mixed with hot water and process aid to form a slurry, the slurry is diluted with additional hot water, the diluted slurry is pumped through a feed line into a primary separation vessel ("PSV") and the diluted slurry is retained for a period of time in the PSV under quiescent conditions, whereby aerated bitumen flecks rise to form an overflow product of primary bitumen froth, solids sink to form an underflow product of tailings, and middlings containing some bitumen flecks are formed in the PSV mid-section, the improvement comprising:

providing a middlings withdrawal line extending from the PSV and connected with a plurality of aeration lines, each comprising an eductor/aerator assembly, said plurality of aeration lines being connected with a return line connected with the PSV;

withdrawing a stream of middlings from the PSV through the withdrawal line and dividing the middlings stream into a plurality of sub-streams by routing the middlings through the aeration lines;

separately aerating each sub-stream by pumping it through the eductor/aerator assembly in the aeration line, thereby forming a central jet of middlings and contacting the jet with a surrounding annular stream of air to generate fine air bubbles which mix with the middlings; and re-combining the aerated sub-streams in the return line and pumping the combined stream through the line to mix the bubbles and middlings prior to recycling the mixture into the PSV.

* * * * *